US008557347B1

(12) United States Patent
Hensley

(10) Patent No.: US 8,557,347 B1
(45) Date of Patent: Oct. 15, 2013

(54) FLAME RETARDANT FABRICS AND METHODS FOR MANUFACTURING THE SAME

(75) Inventor: Malcolm H. Hensley, El Segundo, CA (US)

(73) Assignee: Matchmaster Dyeing & Finishing, Inc., Los Angeles, CA (US)

( * ) Notice: Subject to any disclaimer, the term of this patent is extended or adjusted under 35 U.S.C. 154(b) by 218 days.

(21) Appl. No.: 12/799,952

(22) Filed: May 4, 2010

Related U.S. Application Data

(60) Provisional application No. 61/215,254, filed on May 4, 2009.

(51) Int. Cl.
*B05D 1/38* (2006.01)

(52) U.S. Cl.
USPC ..... 427/389.9; 427/394; 427/412; 427/335; 427/337; 427/340; 427/341; 427/342; 427/355; 427/369

(58) Field of Classification Search
None
See application file for complete search history.

(56) References Cited

U.S. PATENT DOCUMENTS

| | | | | | |
|---|---|---|---|---|---|
| 3,421,923 | A | * | 1/1969 | Guth Christian | 427/337 |
| 3,624,179 | A | * | 11/1971 | Carroll | 428/394 |
| 3,936,562 | A | * | 2/1976 | Duke et al. | 442/71 |
| 3,994,971 | A | * | 11/1976 | Nachbur et al. | 564/15 |
| 4,020,262 | A | * | 4/1977 | LeBlanc et al. | 442/142 |
| 4,046,701 | A | * | 9/1977 | Smith | 252/608 |
| 4,123,574 | A | * | 10/1978 | Wagner | 427/341 |
| 4,145,463 | A | * | 3/1979 | Cole | 427/337 |
| 4,154,890 | A | * | 5/1979 | Wagner | 442/71 |
| 4,156,747 | A | * | 5/1979 | Wagner | 427/341 |
| 4,317,889 | A | * | 3/1982 | Pcolinsky, Jr. | 521/107 |
| 4,451,262 | A | * | 5/1984 | Mayer et al. | 8/125 |
| 5,942,006 | A | * | 8/1999 | Cole | 8/111 |

FOREIGN PATENT DOCUMENTS

GB 1075033 * 7/1967

OTHER PUBLICATIONS

CAS RN 3089-11-0, Nov. 1984.*

* cited by examiner

*Primary Examiner* — Erma Cameron
(74) *Attorney, Agent, or Firm* — Blakely Sokoloff Taylor & Zafman LLP

(57) ABSTRACT

Embodiments of the present invention use melamine-based resins as a pretreatment on fabrics and fabric blends in combination with phosphorus-based flame retardants to improve flame retardant performance, durability, and further promote char formation in a combustion zone of the fabric.

19 Claims, 3 Drawing Sheets

| EXAMPLE | FABRICS | BLEND | COLOR | APPROX. OZ/SQYD | TMMM L/50gal. $H_2O$ | THPS-UREA gal/50gal. $H_2O$ | CHAR LENGTH |
|---|---|---|---|---|---|---|---|
| 1 | INTERLOCK-COTTON, NYLON | 65/35 C/N | WHITE | 5.4 | 20 | 22 | 3.1 in. after 150 washes |
| 2 | JERSEY-COTTON, NYLON, SPANDEX | 77/19/4 C/N/S | TAN | 4.1 | 10 | 16 | 4.5 in. after 30 washes |
| 3 | JERSEY-COTTON, NYLON, SPANDEX | 62/34/4 C/N/S | BEIGE | 4.1 | 15 | 20 | 4.5 in. after 30 washes |
| 4 | PONTE DI ROMA-RAYON, NYLON, SPANDEX | 73/18/9 R/N/S | BEIGE | 9.6 | 20 | 22 | 3.1 in. after 150 washes |
| 5 | RIPSTOP COTTON, NYLON | 48/52 C/N | TAN | 7.5 | 30 | 26 | 4.1 in. after 50 washes |
| 6 | JERSEY COTTON | 100% C | NAVY | 4.4 | 10 | 16 | 3 in. after 170 washes |

C=COTTON
N=NYLON
S=SPANDEX
R=RAYON

Figure 3

FLAME RETARDANT FABRICS AND METHODS FOR MANUFACTURING THE SAME

CROSS-REFERENCE TO RELATED APPLICATION

This application claims the benefit of U.S. Provisional Application No. 61/215,254, filed May 4, 2009.

TECHNICAL FIELD

Embodiments of the present invention relate to flame retardant fabrics.

BACKGROUND

Phosphorus only based flame retardants ("FRs") are typically not effective on nylon. It has been noted that in many cases phosphorus treated nylon fabrics will burn at a greater rate than the untreated fabric. It is believed that in the combustion process the phosphorus containing material forms an acidic environment which causes the nylon polymer to unzip to supply more fuel for combustion. In theory the combustion matrix needs a component that will lower the "acidity" during combustion to minimize the "unzipping" of the nylon polymer.

Many of the phosphorus containing systems for nylon require a halogen with the phosphorus system to be effective. It is not sure how the bromine works but it is assumed that it serves as a free radical scavenger as well as possibly modifying the melt properties of the nylon polymer. However, there is a trend in the industry to minimize the use of halogens as FR materials due to environmental concerns.

The use of sulfur containing materials has been used for years to treat nylon composites to meet various FR standards. The more common systems are based on thiourea and formaldehyde components. However, the hand of the treated fabrics is usually very stiff and there is an odor associated with the finished product. The finished product also has a high level of formaldehyde present. The mechanism of the sulfur containing materials for reducing the flammability is based on modifying the melt behavior of the nylon polymer.

For nylon/cotton blends with 10 percent or higher of nylon, there is generally a molten puddle of the nylon polymer present with flame front in the combustion process, even with FR treated fabrics. In a fire it is perceived that this molten puddle of nylon sticks to the skin of a person wearing the garment and can seriously burn the person. FR cellulosic containing fabrics form a char which helps to provide some insulation to minimize the burn injuries. On the other hand, 100% synthetic containing fabrics and high nylon containing blends can melt and stick to the skin causing serious burns more so than cellulosic fabrics.

Fabric and clothing manufacturers continue to seek improvements in FR fabrics and methods for manufacturing FR fabrics.

SUMMARY

Embodiments of the present invention use melamine-based resins in combination with phosphorus-based flame retardants to greatly improve flame retardant performance, durability, and further promote char formation in the combustion zone of fabrics and fabric blends. Method embodiments of the present invention include a melamine resin in combination with a treatment with a tetrakis(hydroxymethyl)phosphonium-based ("THP") compound, improving the FR performance. There is little effect on the hand and strength loss of the treated fabrics. This improved FR performance may be due to a synergistic effect between phosphorus of the THP and nitrogen of the melamine where the nitrogen may catalyze or promote phosphorylation or char formation in the combustion process. Another object of embodiments of the present invention is to produce a nylon/cellulosic FR fabric which will produce a minimum of molten nylon polymer in the combustion process. Another object is to utilize a reaction of THP chemistry with melamine resin to form a durable FR finish that will meet the flammability requirements after 100 home launderings, especially on lightweight fabrics. Historically, fabrics with high nylon content were treated with a high concentration of a THP-based aqueous solution to increase the final phosphorous loading on the fabric. These fabrics performed extremely poorly on the National Fire Protection Association's ("NFPA") 12 second bottom vertical test. Fabrics produced using methods of the present invention have a greatly improved durability to laundering, and these fabrics pass the NFPA 12 second bottom vertical test after numerous launderings.

BRIEF DESCRIPTION OF THE DRAWINGS

FIG. 3 shows a table summarizing examples of various fabrics treated in accordance with one or more embodiments of the present invention.

DETAILED DESCRIPTION

Figure 1:
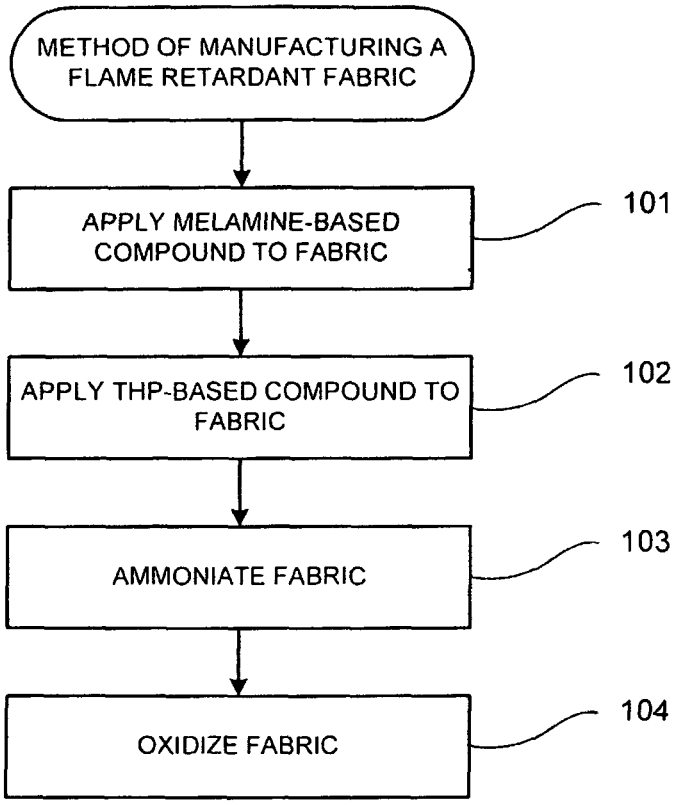
FIG. 1 shows a flow diagram of a method for manufacturing flame retardant fabrics in accordance with one or more embodiments of the present invention.
Figure 2:
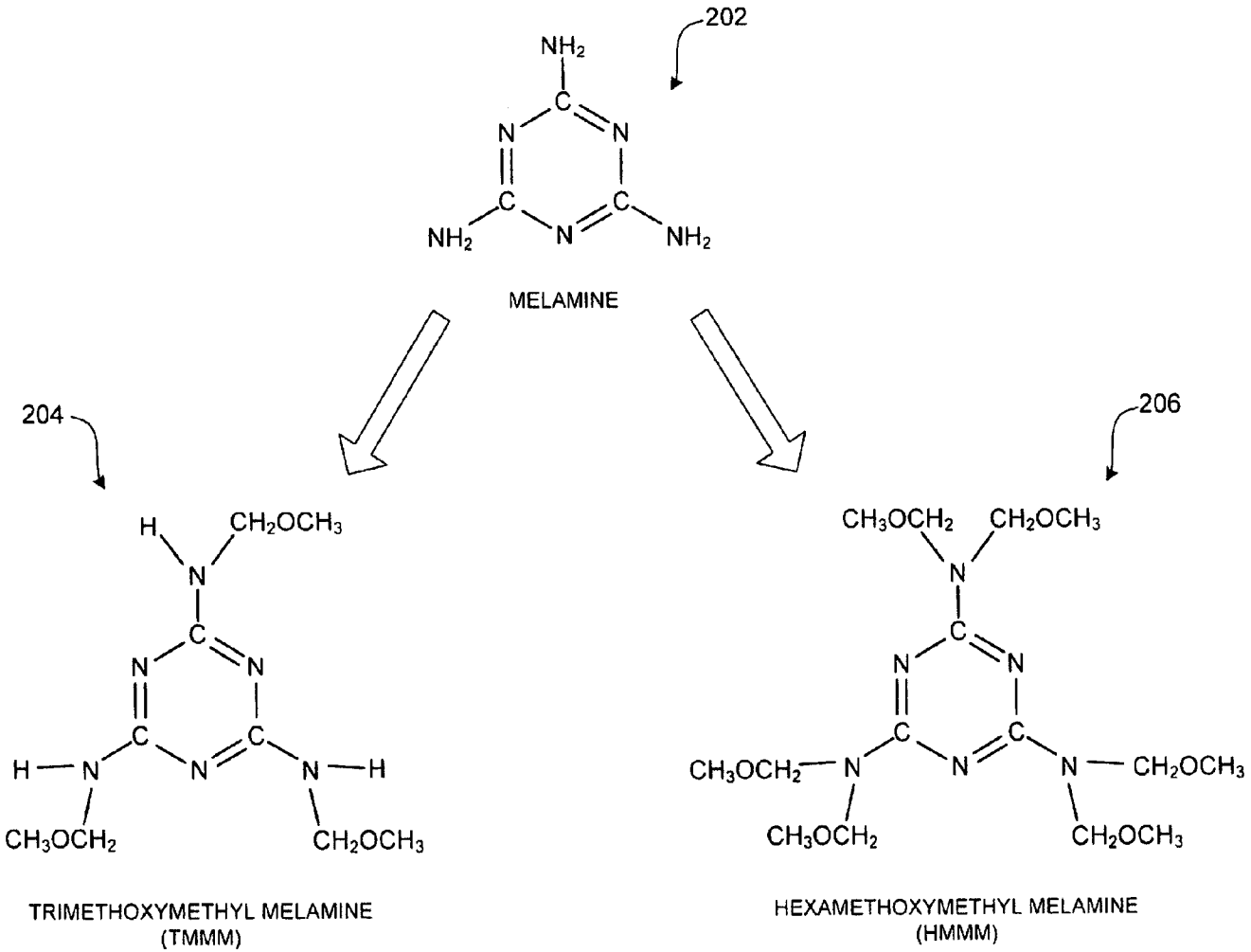
FIG. 2 shows a molecular structure of melamine and molecular structures of melamine-based compounds found in melamine-based resins.

Embodiments of the present invention are directed to methods for manufacturing flame retardant ("FR") fabrics and to fabrics produced by the methods described below. FIG. 1 shows a flow diagram of a method for manufacturing flame retardant fabrics. In step 101, a melamine-based compound is applied to the fabric. Examples of suitable melamine-based compounds for pre-treating the fabric include, but are not limited to, trimethoxymethyl melamine ("TMMM") and hexamethoxymethyl melamine ("HMMM"). FIG. 2 shows molecular structural formulas of melamine 202 and structural formulas of TMMM 204 and HMMM 206.

Returning to FIG. 1, step 101, the melamine-based compound can be in the form of a resin which is diluted in water to form a melamine-based aqueous solution. The melamine-based aqueous solution is applied to the fabric and the fabric is padded, meaning the fabric can be placed in a vat of the melamine-based aqueous solution followed by running the fabric through a pair of narrowly spaced rollers that squeeze or press the fabric. Next, the fabric is cured by placing the fabric in an oven. The oven dwell time and oven temperature depend on the type of fabric. The oven temperatures can range from approximately 300° F. to approximately 450° F., and the temperature of the fabric in the oven ranges from approximately 300° F. to approximately 400° F. The dwell time can range from approximately 20 seconds to approximately 20 minutes, depending on the temperature in the oven and the fabric temperature.

In step 102, a THP-based compound is applied to the fabric. Examples of suitable THP-based compounds include, but are not limited to, tetrakis(hydroxymethyl)phosphonium sulfate urea ("THPS-urea") and tetrakis(hydroxymethyl)phosphonium chloride urea ("THPC-urea"). THPS-urea and THPC-urea are FR compounds. The THP-based compound is combined with water to form a THP-based aqueous solution that can be neutralized to a pH in the range of approximately 5.0 to approximately 7.0 using approximately 5% caustic NaOH or using one or more other suitable alkali agents. Note this pH range is suitable for good fabric strength and FR efficiency, but the process can also run at an even wider range of pHs, such as pHs ranging from approximately 3.0 to approximately 8.0. The THP-based aqueous solution is applied to the fabric and the fabric is padded, as described above in step 101. After the fabric is treated with the THP-based compound, the fabric is dried.

In step 103, the fabric is ammoniated by placing the fabric in an ammonia chamber in order to form a flame retardant polymer containing phosphorous 3. For example, the fabric can be ammoniated by spraying the fabric with, or exposing the fabric to, an anhydrous ammonia gas.

In step 104, the fabric is oxidized, washed and framed. The fabric can be oxidized by placing the fabric in an aqueous solution composed of approximately 10% peroxide. The oxidation process may occur in the same chamber as the ammonia chamber or in a separate chamber. Other suitable oxidizing agents include, but are not limited to, sodium percarbonate or ozone. After the fabric is ammoniated, oxidation sets the melamine-based compound and the THP-based compound as a flame retardant polymer in the fabric by converting the phosphorous 3 to phosphorous 5.

Note that embodiments of the present invention are not limited to step 1 being performed before step 2. In other embodiments, step 2 can be performed before step 1. For example, the process of applying a THP-based compound to a fabric described in step 2 can be applied before application of the melamine-based compound described in step 1.

The fabric can be composed of a cellulosic material including, but not limited to, cotton, rayon, tencel or flax. It can be composed of a blend of nylon and one or more cellulosic materials. The fabric can also be a blend of one or more cellulosic materials and one or more synthetic materials, such as nylon, spandex, acrylic, acetate or triacetate. Examples of nylon blended fabrics include, but are not limited to, a nylon/cellulose blend, a nylon/cotton blend, a cotton/nylon/spandex blend, or a rayon/nylon/spandex blend.

EXAMPLES

Examples of fabrics treated using the above described methods are now described. FIG. 3 shows a table summarizing the various flame retardant fabrics produced in the following examples in accordance with one or more embodiments of the present invention.

Example 1

The fabric treated in this example was a 5.4 ounces per square yard interlock 65% cotton 35% nylon blend. The pretreatment consists of padding a bath containing approximately 20 liters of TMMM product per 50 gallons. The wet pick up was approximately 86%. The resin treated fabric was cured at approximately 370° F. for about two minutes. In the second step the pretreated fabric was padded with a mix containing 22 gallons of THPS-Urea condensate per 50 gallons of water. The FR treated fabric was dried at approximately 270° F. to about 10% moisture after which the FR treated fabric was ammoniated, oxidized, washed and framed. The fabric was then evaluated for hand and drape and was extremely soft. The char length was only 3.1 inches after 150 home laundries.

Example 2

The fabric treated in this example was a light 4.1 ounces per square yard jersey cotton/nylon/spandex having approximately 77% cotton, 19% nylon, and 4% spandex. The fabric has a minimum tear strength, but it was not possible to make a fabric with more nylon content because of the difficulty in making this blend flame resistant. The fabric was padded with a bath containing approximately 10 liters of the TMMM per 50 gallons. The wet pick up was approximately 80%. The resin treated fabric was cured at approximately 370° F. for about one and a half minutes. In the second step, the resin treated fabric was padded with a mix containing 16 gallons of THPS-Urea condensate per 50 gallons of water. The FR treated fabric was dried at approximately 270° F. to about 10% moisture. The FR treated fabric was ammoniated, oxidized, washed and framed. The fabric was then evaluated for hand and drape, and the hand was extremely soft. The fabric was stronger, and the char length was 4.5 inches after 30 home laundries. Historically, when treated with a high concentration of a THP-based aqueous solution to increase final phosphorous loading on the fabric, this fabric would have a char length greater than 7 inches after only 5 home laundries. The burst strength of the fabric used in this example was 44 pounds per square inch, compared to 40 pounds per square inch using traditional methods.

Example 3

The fabric treated in this example was a light 4.1 ounces per square yard of jersey cotton/nylon/spandex, with approximately 62% cotton, 34% nylon, and 4% spandex. The fabric was pretreated with a mix containing approximately 15 liters of TMMM per 50 gallons. The wet pick up was approximately 82%. The resin treated fabric was cured at approximately 370° F. for about one and a half minutes. In the second step the pretreated fabric was padded with a mix having 20 gallons of THPS-Urea condensate per 50 gallon of mix. The FR treated fabric was dried at approximately 270° F. to about 10% moisture. The FR treated fabric was ammoniated, oxidized, washed and framed. The fabric was then evaluated for hand and drape. The fabric was stronger, and the char length was only 4.5 inches after 30 home laundries. The burst strength of the fabric used in this example was 52 pounds per square inch, compared to 40 pounds per square inch using traditional methods.

Example 4

The fabric treated in this example was a 9.6 ounces per square yard Ponte di roma 73% rayon, 18% nylon, and 9% spandex blend. The fabric was pretreated with a resin mix containing approximately 20 liters of TMMM per 50 gallons. The wet pick up was approximately 80%. The resin treated fabric was cured at approximately 370° F. for about two minutes. In the second step the pretreated fabric was padded with a mix containing 22 gallons of THPS-Urea condensate per 50 gallons of water. The FR treated fabric was dried at approximately 270° F. to about 10% moisture. The FR treated fabric was ammoniated, oxidized, washed and framed. The fabric was then evaluated for hand and drape. It also had a good hand. Much like Example 1, the char length was only 3.1 inches after 150 home laundries.

Example 5

The fabric treated in this example was a 7.5 ounces per square yard ripstop 52% nylon and 48% cotton blend. The fabric was pretreated with a resin mix containing approximately 30 liters of TMMM per 50 gallons. The wet pick up was approximately 86%. The resin treated fabric was cured at approximately 370° F. for about two minutes. In the second step the resin treated fabric was padded with a mix containing 26 gallons of THPS-Urea condensate per 50 gallons of water. The FR treated fabric was dried at approximately 270° F. to about 10% moisture. The FR fabric was ammoniated, oxidized, washed and framed. The fabric was then evaluated for hand and drape. It was not soft. Durability of the flame retardant process was good, but this was an off the shelf ripstop with 52 fills per inch. It may be necessary to design a more open ripstop fabric to get a more acceptable fabric, perhaps 46-48 fills per inch. The char length was only 4.1 inches after 50 home laundries. A similar fabric produced using traditional methods and tested even before a single home laundry would not stop burning, and the test sample was consumed. Instead, in our example there was no molten nylon polymer in the burning zone. The char would break down to a fine powder when pressed between the fingers and thumb. There was no rigid plastic-like residue.

Example 6

The fabric treated in this example was a 4.4 oz./sq. yd. jersey comb cotton. The fabric was pretreated with a resin mix having 10 liters of TMMM per 50 gallons. The treated fabric was cured at approximately 330° F. In the second step the resin treated fabric was padded with a mix containing 16 gallons of THPS-Urea Condensate per 50 gallons of water [pH approximately 6.2]. The FR treated fabric was dried at approximately 270° F. to about 10% moisture. The FR treated fabric was ammoniated oxidized, washed, and framed. The average char length was 3 inches after 170 home laundries. Using traditional methods, a fabric that performed this well on the burn test would have a significantly harsher hand.

The foregoing description, for purposes of explanation, used specific nomenclature to provide a thorough understanding of the invention. However, it will be apparent to one skilled in the art that the specific details are not required in order to practice the invention. The foregoing descriptions of specific embodiments of the present invention are presented for purposes of illustration and description. They are not intended to be exhaustive of or to limit the invention to the precise forms disclosed. Obviously, many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents:

The invention claimed is:

1. A method for flame retarding a fabric comprising:

applying a melamine-based compound to a fabric, wherein applying the melamine-based compound to the fabric further comprises curing with heat at oven temperatures of 330° F. or greater;

separately applying a tetrakis(hydroxymethy)phosphomium ("THP")-based compound to the fabric; and fixing the melamine-based compound and THP-based compound as a flame retardant in the fabric.

2. The method of claim 1, wherein applying the melamine-based compound to the fabric further comprises padding the melamine-based compound onto the fabric.

3. The method of claim 2, wherein padding the melamine-based compound onto the fabric further comprises:

applying a melamine-based solution to the fabric; and pressing the melamine-based solution onto the fabric.

4. The method of claim 1, wherein curing with heat further comprises heating the fabric to a temperature of greater than approximately 300° F.

5. The method of claim 4, wherein curing with heat further comprises exposing the fabric to the heat for more than approximately 20 seconds.

6. The method of claim 1, wherein the melamine-based compound further comprises trimethoxymethyl melamine.

7. The method of claim 1, wherein the melamine-based compound further comprises hexamethoxymethyl melamine.

8. The method of claim 1, wherein applying the THP-based compound further comprises padding the THP-based compound onto the fabric.

9. The method of claim 8, wherein padding the THP-based compound onto the fabric further comprises:

applying a THP-based aqueous solution to the fabric, wherein the THP-based aqueous solution includes the THP-based compound in water neutralized to a pH of approximately 3.0 to approximately 8.0; and pressing the THP-based aqueous solution onto fabric.

10. The method of claim 1, where THP-based compound further comprises tetrakis(hydroxymethyl)phosphonium sulfate urea.

11. The method of claim 1, wherein THP-based compound further comprises tetrakis(hydroxymethyl)phosphonium chloride urea.

12. The method of claim 1, wherein fixing the melamine-based compound and THP-based compound as a flame retardant in the fabric, further comprises exposing the fabric to an ammonia source in an ammonia chamber; and after exposing the fabric to the ammonia source, exposing the fabric to an oxidizing agent.

13. The method of claim 12, wherein exposing the fabric to an ammonia source in the ammonia chamber further comprises:

drying the fabric to a moisture content of approximately 10%;

framing the fabric; and exposing the fabric to ammonia.

14. The method of claim 12, wherein exposing the fabric to an oxidizing agent comprises placing the fabric in an aqueous solution composed of approximately 10% peroxide.

15. The method of claim 1, wherein the fabric further comprises a fabric made of cellulosic material.

16. The method of claim 1, wherein the fabric further comprises a fabric made of a blend of nylon and one or more cellulosic materials.

17. The method of claim 1, wherein the fabric further comprises a fabric made of a blend of:

one or more cellulosic materials selected from the group consisting of cotton, rayon, tencel, or flax; and one or more synthetic materials selected from the group consisting of nylon, acrylic, spandex, acetate or triacetate.

18. The method of claim 1, wherein applying the melamine-based compound precedes applying the THP-based compound.

19. The method of claim 1, wherein the fabric comprises between 0 percent and 52 percent nylon.

* * * * *

UNITED STATES PATENT AND TRADEMARK OFFICE

CERTIFICATE OF CORRECTION

PATENT NO. : 8,557,347 B1
APPLICATION NO. : 12/799952
DATED : October 15, 2013
INVENTOR(S) : Malcolm H. Hensley It is certified that error appears in the above-identified patent and that said Letters Patent is hereby corrected as shown below:

In the Claims, Column 6, Claim 1, line 1, please delete "hydroxymethy" and insert --hydroxmethyl--.

Signed and Sealed this
Eleventh Day of February, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,557,347 B1
APPLICATION NO. : 12/799952
DATED : October 15, 2013
INVENTOR(S) : Malcolm H. Hensley It is certified that error appears in the above-identified patent and that said Letters Patent is hereby corrected as shown below:

In the Claims, Column 6, Claim 1, line 1, please delete "hydroxymethy" and insert --hydroxymethyl--.

This certificate supersedes the Certificate of Correction issued February 11, 2014.

Signed and Sealed this
First Day of July, 2014

Michelle K. Lee

Michelle K. Lee
*Deputy Director of the United States Patent and Trademark Office*